US008890442B2

(12) United States Patent
Radermacher

(10) Patent No.: US 8,890,442 B2
(45) Date of Patent: Nov. 18, 2014

(54) LIGHT EMITTING DEVICE SYSTEM AND DRIVER

(75) Inventor: Harald Josef Günther Radermacher, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 587 days.

(21) Appl. No.: 13/201,066

(22) PCT Filed: Feb. 1, 2010

(86) PCT No.: PCT/IB2010/050428

§ 371 (c)(1), (2), (4) Date: Nov. 17, 2011

(87) PCT Pub. No.: WO2010/092504

PCT Pub. Date: Aug. 19, 2010

(65) Prior Publication Data

US 2012/0119662 A1 May 17, 2012

(30) Foreign Application Priority Data

Feb. 12, 2009 (EP) ..... 09152691

(51) Int. Cl.
*H05B 37/02* (2006.01)
*H05B 33/08* (2006.01)

(52) U.S. Cl.
CPC ..... *H05B 37/0263* (2013.01); *H05B 33/0821* (2013.01)
USPC ..... 315/308; 315/360

(58) Field of Classification Search
CPC ..... H05B 37/02; H05B 33/08; H05B 33/0896
USPC ..... 315/291, 308, 360
See application file for complete search history.

(56) References Cited

U.S. PATENT DOCUMENTS

| | | | | |
|---|---|---|---|---|
| 6,127,784 | A | 10/2000 | Grossman et al. | |
| 6,313,589 | B1 | 11/2001 | Kobayashi et al. | |
| 6,975,214 | B2 * | 12/2005 | Schleicher | 340/435 |
| 8,093,830 | B2 * | 1/2012 | Inoue | 315/291 |
| 2004/0056774 | A1 | 3/2004 | Schleicher | |
| 2007/0246546 | A1 | 10/2007 | Yoshida | |
| 2008/0084169 | A1 | 4/2008 | Wendt et al. | |
| 2008/0200119 | A1 | 8/2008 | Onishi et al. | |

FOREIGN PATENT DOCUMENTS

| | | | |
|---|---|---|---|
| GB | 2284952 | A | 6/1995 |
| WO | 2008001274 | A2 | 1/2008 |

* cited by examiner

*Primary Examiner* — Thuy Vinh Tran
(74) *Attorney, Agent, or Firm* — Yuliya Mathis

(57) ABSTRACT

The invention relates to a driver (100) for a light emitting device system (112), comprising power supply terminals (108) and a detector circuit (106), the power supply terminals being adapted for supplying electrical power from the driver (100) to the light emitting device system and the detector circuit being adapted for capturing sensed information of the light emitting device system via the supply terminals by sensing an electrical loading of the terminals caused by the light emitting device system and for determining an operating condition of the light emitting device system, using the sensed information, wherein the driver is further adapted to control the supplied power depending on the determined operating condition.

13 Claims, 4 Drawing Sheets

LIGHT EMITTING DEVICE SYSTEM AND DRIVER

TECHNICAL FIELD

The invention relates to a driver for a light emitting device system and a light emitting device system.

BACKGROUND AND RELATED ART

Solid State Light (SSL) sources such as, but not limited to, light emitting diodes (LEDs) will play an increasingly significant role in general lighting in the future. This will result in more and more new installations being equipped with LED light sources in various ways. The reason for replacing state of the art light sources with LED light sources is e.g. the lower power consumption of LED light sources and their extremely long lifetime.

Typically, an LED is driven by means of a special circuit, which is called the driver. In order to permit the operation of different kinds of LED light sources with a given driver to come to a more or less modular system, it is desirable that LED lamps are able to communicate their required supply power characteristics to the driver. This allows replacing the LED lamp with a newer version offering for example better efficiency or a wider color range without changing the driver. Further, this allows reducing the different types of drivers held in stock.

For example US 2004/0056774 A1 discloses a supply unit for at least one LED unit, wherein the supply unit has a detection unit designed for detecting the identity of the LED unit by means of electrical quantities. The identity of the LED unit is detected via the supply terminals of the supply unit, the supply terminals being adapted for supplying power to the LED unit.

However, this allows only for the detection of an identity of an LED unit, not a dynamic adaptation of the characteristics of the supplied power depending on the actual requirements of the LED lamp. In case an LED lamp is connected to an LED driver, the driver may thus only detect some fixed internal parameters of the lamp and set the power accordingly to these fixed parameters. This system lacks the ability to drive the lamp accordingly under different operation conditions of the lamp.

SUMMARY OF THE INVENTION

The present invention provides a driver for a light emitting device system, comprising power supply terminals and a detector circuit, the power supply terminals being adapted for supplying electrical power from the driver to the light emitting device system and the detector circuit being adapted for capturing sensed information of the light emitting device system via the supply terminals by sensing an electrical loading of the terminals caused by the light emitting device system and for determining an operating condition of the light emitting device system, using the sensed information, wherein the driver is further adapted to control the supplied power, depending on the determined operating condition. Throughout the description, a light emitting device system is understood as a solid state light system, comprising for example at least one OLED lamp, an LED lamp or a laser lamp.

Embodiments of the invention have the advantage that the driver can be used to dynamically adjust the electrical power provided to the light emitting device system, depending on the actual power requirements of the light emitting device system. The actual power requirements depend on operating conditions of the light emitting device system. For example, without loss of generality, an operating condition may comprise an actual light emission characteristic of the light emitting device system and/or a temperature of the light emitting device system and/or an environmental condition of the environment in which the light emitting device system is being operated and/or a time of operation of the light emitting device system.

Since the information about the operating condition of the light emitting device system is captured only via the supply terminals, no additional signal connections like, for example, extra pins are required for signaling information from the light emitting device system to the driver. As a consequence, for example the risk of a malfunction of the light emitting device system due to loose contacts is reduced. Further, this allows for the provision of light emitting device systems at lower costs and even in a miniaturized way.

In accordance with an embodiment of the invention, the sensed information is comprised in an impedance emulated by the light emitting device system and captured by the detector circuit by the sensing of the electrical loading of the terminals caused by the light emitting device system. The light emitting device system comprises at least one sensor, which can detect an actual operating condition of the light emitting device system. This operating condition is encoded as information in a certain impedance which is emulated by the light emitting device system and processed to the driver.

In accordance with an embodiment of the invention, the sensed information is comprised in a sequence of impedances emulated by the light emitting device system and captured by the detector circuit by the sensing of the electrical loading of the terminals caused by the light emitting device system. In this case, even a complex digital encoding of the sensed information can be performed by means of the sequence of impedances emulated by the light emitting device system. For example, the impedance of the light emitting device system is modulated by the sensed information.

In general, the sensed information being comprised in the impedance emulated by the light emitting device system has the advantage of a rather simple and cost effective technical implementation. For example, a simple resistor could be used which is turned on and off for modulating the electrical loading of the light emitting device system. In a more complex version, the resistor may be a tunable resistor, wherein the light emitting device system performs time-dependent tuning and/or turning on and off of the resistor in order to provide in a dynamic way an electrical loading to the driver.

Further, an advantage of the emulation of the impedance is that such emulation can be designed to have no significant influence on the power path of the light emitting device system.

In accordance with an embodiment of the invention, the electrical power is supplied sequentially to the light emitting device system with a first and a second power signal characteristic, wherein the detector circuit is adapted for capturing the sensed information of the light emitting device system only during provision of the electrical power with the second power signal characteristic, the first power signal characteristic being different from the second power signal characteristic. Here, power signal characteristic is understood as any physical characteristic of the power signal itself. Such a characteristic may for example comprise the polarity, voltage, current, phasing, frequency or waveform or any combination thereof. For example, it is possible to supply a DC-signal as the first power signal characteristic and to supply the DC signal with a superimposed AC signal as the second power signal characteristic.

For example, the electrical power is supplied sequentially to the light emitting device system by an alternating current in a first and second frequency range, wherein the detector circuit is adapted for capturing the sensed information of the light emitting device system only in the second frequency range, the first frequency range being different from the second frequency range.

An advantage embodiment in which in case the electrical power is supplied to the light emitting device system by the alternating current in the first frequency range, a respective emulation circuit of the light emitting device system will not be active during said power provision in the first frequency range. Preferably, the emulation circuit is adapted for causing a significant loading of the power supply terminals only in the second frequency range. This could be achieved by means of a bandpass filter-like behavior of the emulation circuit. During time intervals when this second frequency range is not excited by the driver, the circuit has nearly no effect on the power flow between the driver and the light emitting diode device system.

In accordance with an embodiment of the invention, in a generalized manner, the light emitting system is operable for light emission by receiving electrical power with a first or a second power signal characteristic, wherein the light emitting device system further comprises an emulation circuit adapted for emulating the electrical loading, wherein the emulation circuit is adapted to emulate the electrical loading with a higher effectiveness when receiving the electrical power with the second power signal characteristic than when receiving the electrical power with the first power signal characteristic.

For example, the provision of the supplied power to the light emitting device system is only performed at certain time intervals in the second frequency range and during the rest of the time in the first frequency range, such that in between the time intervals the emulation circuit of the light emitting device system will not unnecessarily consume electrical power since it is not responding to the first frequency range. Only at said certain time intervals, the driver switches the provision of the alternating current from the first to the second frequency range and in turn the detector circuit captures the sensed information of the light emitting device system. Only in this case the emulation circuit of the light emitting device system becomes 'active', i.e. resonant, and influences the power flow, e.g. by consuming some energy. As a further consequence, the emulation circuit of the light emitting device system can be passively turned on and off.

A further advantage of the usage of different frequency ranges is that a more intelligent light emitting device system may detect by means of sensing in the relevant frequency range whether it is powered from a driver which supports the novel signaling method by capturing sensed information of the light emitting device system in a certain frequency range. In case only a 'low-end driver' is connected to the light emitting device system which does not support the signaling method, the light emitting device system can switch off its sensor and emulation circuits, thus further reducing the power consumption of the system. In contrast, in case the light emitting device system detects that it is powered from a 'high-end driver' which supports the above mentioned signaling method, the sensor and the emulation circuit can be activated in accordance with the provision of the electrical power by the alternating current in the second frequency range in order to provide the operating conditions of the light emitting device system to the driver.

In accordance with an embodiment of the invention, the driver is adapted for switching between a first and a second operation mode, wherein in the first operation mode a driver is adapted to supply the power to the light emitting device system by alternating current in the first frequency range and the detector circuit is disabled, and wherein in the second operation mode the driver is adapted to supply the power to the light emitting device system by alternating current in the second frequency range and the detector is enabled for capturing the sensed information of the light emitting device system. As mentioned above, this allows for a reduction of the driver's power consumption since the driver is only actively capturing the sensed information of the light emitting device system in case the alternating current is provided to the light emitting device system in the second frequency range.

It has to be noted that preferably any of the used frequencies, including the first and second frequency ranges, are so high that a user of the light emitting device system will not be able to see a distortion (e.g. an optical flicker) during operation at a frequency range or during transition between the different frequency ranges at which the electrical power is supplied to the light emitting device system and which cause a light emitting diode to be turned on and off in accordance with the actual current direction.

In accordance with a further embodiment of the invention, the detector circuit is adapted for capturing the sensed information of the light emitting device system by demodulating the impedance emulated by the light emitting device system.

In accordance with a further embodiment of the invention, the driver is further adapted to provide sensed information to an external control system and to receive a control command from the external control system in response to the provision of the sensed information, wherein the driver is adapted to control the supplied power, depending on the control command. For example, the external control system may be a superordinate control network like for example a DALI network. DALI stands for Digital Addressable Lighting Interface and is a protocol set out in the technical standard IEC62386. By means of such a superordinate control network, it is possible to have full control even over a complex system comprising a multitude of light emitting diode units. This is especially valuable for parameters like for example the temperature to monitor the light emitting diode lamps or burning hours to replace the lamps after a certain time.

In accordance with a further embodiment of the invention, the electrical loading of the light emitting device system is further sensed with respect to earth potential. In other words, it is possible for the driver to make use of common mode effects to detect sensed information. In such an embodiment, the (parasitic) capacity of the light emitting device system with respect to the earth potential is utilized. Such an embodiment could comprise a light emitting diode unit with two power supply terminals and a metal housing for cooling. The sensor in the light emitting diode unit is adapted to influence the coupling between the power supply terminals and the metal housing.

In a further aspect, the invention relates to a light emitting device system comprising power supply terminals, a sensor and an emulating circuit, the power supply terminals being adapted for receiving electrical power from a driver, the sensor being adapted for sensing an operating condition of the light emitting device system, wherein the light emitting device system is further adapted for providing the sensed operating condition as sensed information via the power supply terminals to the driver by emulating a detectable electrical loading, depending on the sensed operating condition.

In accordance with an embodiment of the invention, the light emitting system is operable for light emission by receiving electrical power with a first or a second power signal characteristic, wherein the light emitting device system further comprises an emulation circuit adapted for emulating the electrical loading, wherein the emulation circuit is adapted to emulate the electrical loading with a higher effectiveness when receiving the electrical power with the second power signal characteristic than when receiving the electrical power with the first power signal characteristic.

For example, the light emitting device system is operable for light emission by receiving an alternating current in a first or second frequency range, wherein the light emitting device system further comprises an emulation circuit adapted for emulating the electrical loading, wherein the emulating circuit is only active in a second frequency range.

In accordance with an embodiment of the invention, the light emitting device system is operable for light emission by receiving a DC current, wherein the light emitting device system further comprises an emulation circuit adapted for emulating the electrical loading, wherein the emulating circuit is only active in a certain frequency range.

In accordance with a further embodiment of the invention, the electrical loading of the light emitting device system is emulated with respect to earth potential.

BRIEF DESCRIPTION OF THE DRAWINGS

In the following, preferred embodiments of the invention are described in greater detail merely by way of example, making reference to the drawings in which.

DETAILED DESCRIPTION

Figure 1:
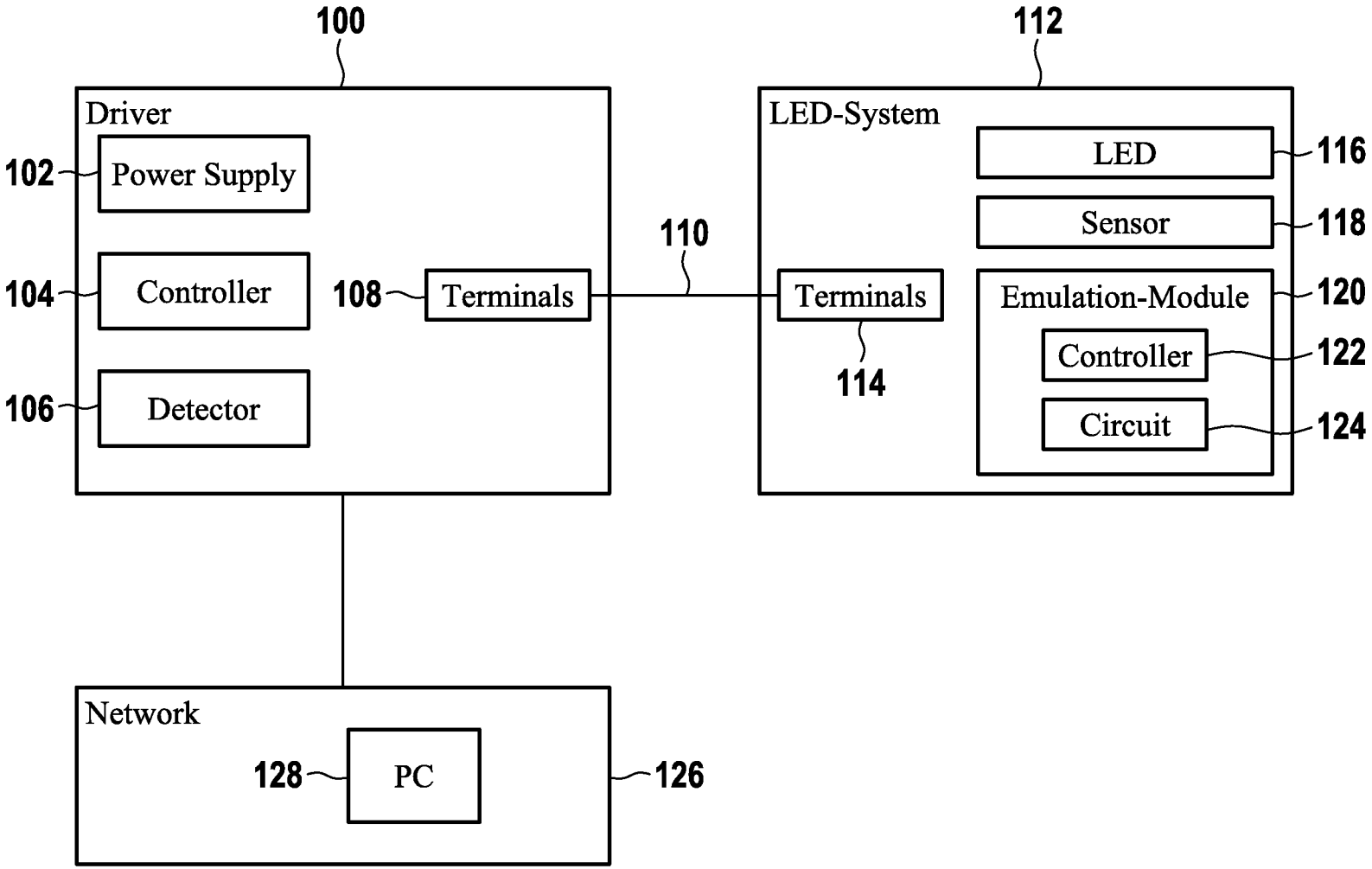
FIG. 1 is a block diagram illustrating a light emitting device system and a driver.

FIG. 1 is a block diagram illustrating a driver 100 and a light emitting device system 112. The driver comprises a power supply 102 and power supply terminals 108. The light emitting device system 112 comprises power supply terminals 114, wherein the power supply terminals 108 of the driver 100 and the power supply terminals 114 of the light emitting device system 112 are interconnected by means of a cable 110. Alternatively, instead of a cable other means could be used for connection 110, e.g. a lighting rail system.

The light emitting device system 112 comprises an LED, which may for example be a conventional light emitting diode or for example an organic light emitting diode (OLED).

In order to operate the light emitting device system 112, the driver 100 supplies electrical power via the power supply terminals 108, the cable 110 and the power supply terminals 114 to a light emitting diode 116.

The light emitting device system 112 further comprises a sensor 118 which may be for example a temperature sensor. The temperature sensor 118 is adapted for sensing for example the temperature of the circuit board of the light emitting device system 112. In case the circuit board of the light emitting device system 112 is heated to a critical temperature by the operation of the light emitting device system, the sensor 118 will detect this temperature and report the temperature to an emulation module 120.

The emulation module 120 comprises a controller 122 and a circuit 124. In the embodiment of FIG. 1, the controller 122 is an active controller comprising for example a processor. The controller 122 may receive the temperature value from the sensor 118 and recognize the overheating of the light emitting device system board as sensed information. Thus, the operating condition of the light emitting device system will be 'overheating'.

The controller 122 is further adapted for modulation of the impedance of the light emitting device system 112 via the circuit 124. The modulation of the impedance can be performed prior to and/or during operation of the light emitting device system 112 to communicate data to the driver 100. For example, the circuit 124 comprises a controllable resistor, e.g. a MOSFET, wherein the resistance is modulated in accordance with the information to be provided to the driver 100. In the present example, the controller 122 detects overheating of the light emitting device system board as operation condition of the light emitting device system 112, wherein the controller 122 subsequently tunes the circuit 124 for a respective impedance variation in order to communicate the operation condition 'overheating' to the driver.

While providing electrical power to the light emitting device system 112, the driver 100 detects the impedance variation of the light emitting device system 112 via the supply terminals 108, the cable 110 and the supply terminals 114. The detection of the impedance variation is performed by means of a detector 106 of the driver 100. In other words, the detector 106 captures the sensed information 'overheating of the light emitting device system board' by sensing a respective assigned variation of the electrical loading of the light emitting device system 112. In response, a controller 104 of the driver 100 controls the power supplied by means of the power supply 102, depending on the operating condition 'overheating'. For example, the controller 104 may control the power supply 102 to reduce the electrical power supplied to the light emitting device system 112, which will lead to a certain cooling of the light emitting device system board.

Further illustrated in FIG. 1 is a network 126, which can be for example a superordinate control network. In case the network is present, the operating condition of the light emitting device system 112 may be forwarded to this network. For example a data processing system like a personal computer (PC) 128 may be part of the network and can be used in real time to display the failure of the light emitting device system 112 'overheating'. Either the PC 128 may in response automatically send a command to the driver 100 to reduce the electrical power supplied to the light emitting device system 112, or a user may be given the options to turn off the light emitting device system 112 or to set the supplied power to a certain value. The user's choice will then be forwarded from the network to the driver 100 which will execute the respective user command—either turning off the light emitting device system 112 or setting the supplied power to the value selected by the user via the PC 128.

Regarding the sensor 118 it has to be noted that various kinds of sensors can be used in the light emitting device system 112. Besides temperature sensors also sensors can be used which can sense the environmental conditions of the environment in which the light emitting device system is operated. Without loss of generality, for example, such a sensor may be a light sensor, a humidity sensor, a dust sensor, a fog sensor or a proximity sensor.

For example, in case a light sensor senses bright daylight, the emulation can be performed in such a manner that only a minimal current is supplied by the driver 100 to the light emitting device system 112, since obviously a high level of additional light emission from the light emitting device system is not required. In contrast, in case the ambient light detection sensor 118 senses darkness, the emulation by the circuit 124 may be performed such as to provide the driver 100 with information that electric power is required in such a manner that the light emitting device system 112 is powered for a maximum bright light emission.

In further embodiments of the invention, the sensor 118 can be used for flux stabilization by means of measuring the flux generated by the light emitting diode 116, using as sensor 118 a photodiode or light dependent resistor (LDR) adapted to sense at least a part of the light generated by the light emitting diode 116. It has to be noted that in case a light dependent resistor is used as circuit 124, this LDR can be permanently used directly as part of the emulation module 120 without the need to additionally provide a controller 122. In this case, the emulation module 120 is a passive emulation module.

A further application of the driver 100 and the light emitting device system 112 is the following: in case the light emitting diode 116 used is a set of light emitting diode strings, when dimming the light emitted from the light emitting diode 116, depending on for example the polarity or frequency of the power supplied from the driver 100, the different strings are activated or deactivated. In this case, the light emitting device system 112 further comprises an additional controller which controls the power supply to individual light emitting diodes or light emitting diode strings, depending on the power characteristics supplied from the driver 100 to the light emitting device system 112. Additionally, prior to such an operation, respective operation data may be communicated from the light emitting device system 112 to the driver 100. In other words, prior to operation, the driver may be instructed by means of the controller 122 and the circuit 124 about required power characteristics like waveforms in order to allow for a static or dynamic activation or deactivation of different strings of the light emitting device system.

Figure 2:
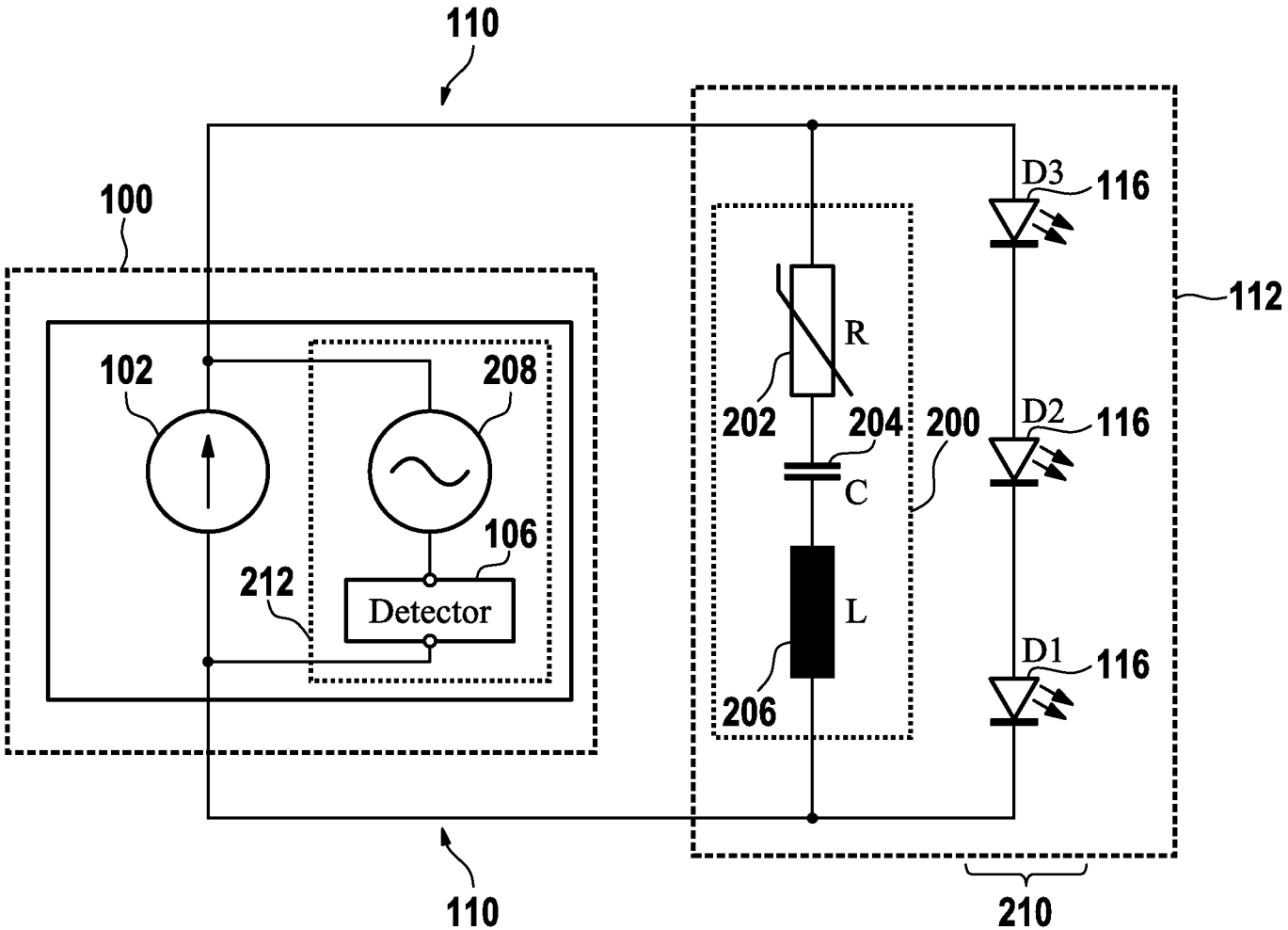
FIG. 2 is a schematic illustrating a circuit diagram of a driver and a light emitting device system.

FIG. 2 is a schematic view of a circuit diagram of a driver 100 and a light emitting device system 112. In the following, similar elements are indicated by the same reference numerals.

The driver 100 comprises a DC current source 102. The light emitting device system 112 comprises a set of light emitting diodes 116, i.e. the light emitting diodes D1, D2 and D3, which form an LED string 210. The current source 102 and the light emitting diodes 116 are interconnected via supply terminals, which correspond to the terminals 108 and 114 in FIG. 1, by means of wires 110, which may also include connectors and respective sockets.

In addition to the light emitting diode string 210 comprising the light emitting diodes 116, the light emitting device system 112 further comprises a circuit 200. The circuit 200 comprises an impedance 206, a capacitance 204 and a variable resistor 202, which are arranged in series with respect to each other. The circuit 200 is arranged parallel to the light emitting diode string 210. The circuit 200 acts as frequency selection circuitry whose impedance can be tuned by means of the variable resistor 202. In the simplest case, this variable resistor 202 may be a temperature dependent resistor or a light dependent resistor. It has to be noted that the circuit 200 may be any circuit which is adapted to emulate a predefined impedance when receiving electrical power with a predefined power signal characteristic, which may for example comprise a certain frequency range, as will be further described without loss of generality in this example. The power signal characteristic may also comprise a polarity, voltage, current, phasing or waveform or any combination thereof.

In normal, steady state DC operation, the circuitry 200 will not influence the power delivered to the light emitting diode string 210. However, with a dedicated driver 100, the impedance of the circuitry 200 can be detected. For this purpose, the driver 100 includes a sensing part 212 which comprises an AC voltage source 208 and a current detector 106. At a certain frequency and voltage amplitude provided as electrical power to the light emitting device system 112, a certain current will flow through the circuitry 200 since the circuitry 200 becomes resonant. By sensing the impedance at one or several discrete frequencies or by sensing the impedance during a frequency sweep or by applying pulses to measure the frequency response, the impedance 'emulated' by the light emitting device system 112 using the circuitry 200 can be detected.

It has to be noted that instead of using a separate detector 106, it is possible to incorporate the detector in a control loop of the power source 102.

In case the impedance of the sensing part 200 has to be detected independently of the impedance of the light emitting diode string 210, the effect of the light emitting diodes may be compensated for in the control circuitry of the driver. A further solution would be to deactivate the current source and only use a small sensing voltage, which does not reach the forward voltage of the light emitting diode string but is sufficient to sense the electrical loading due to the presence of the circuit 200. In such a case short sensing intervals are preferred to avoid visible artifacts in the light output of the light emitting diode string 210.

By using a predetermined nomenclature or impedance coding scheme, information can be 'stored' in the light emitting diode lamp and read back by the driver without additional cabling or connectors. Hence, this method is especially suited for light emitting diode lamps which are used in luminaries at low cost, and low terminal count sockets.

Figure 3:
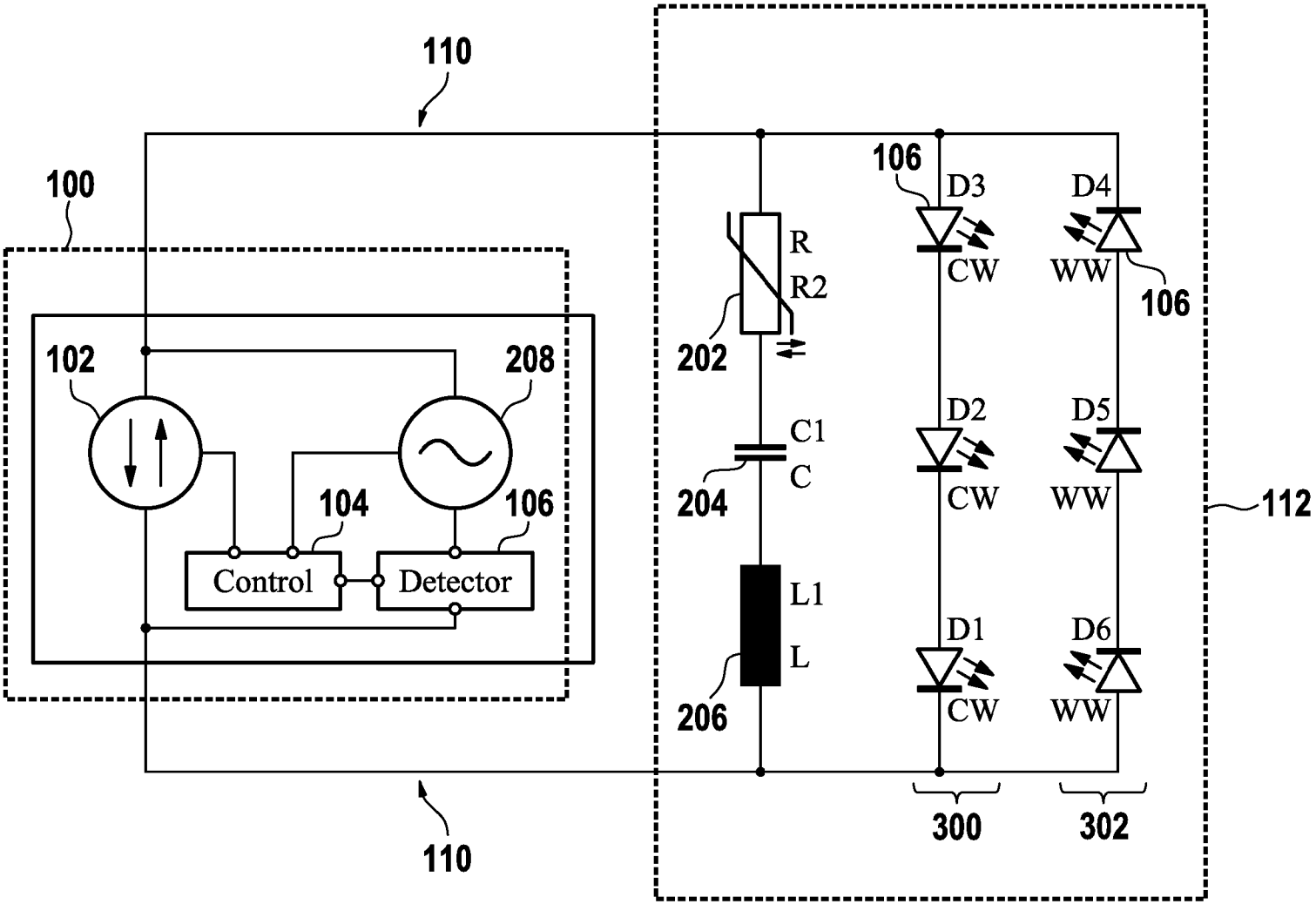
FIG. 3 is a further schematic illustrating a circuit diagram of a further driver and a further light emitting device system.

FIG. 3 is a further schematic of a more advanced version of a driver 100 and a light emitting device system 112. In FIG. 3, the light emitting diode lamp consists of two anti-parallel strings 300 and 302 with different types of light emitting diodes 106, e.g. warm white (WW) and cold white (CW) light emitting diodes. Now, the driver 100 can be set to supply both polarities at a higher repetition rate. The ratio of the power delivered to the two light emitting diode strings determines the resulting color temperature of the total light output.

During light emitting diode production, light emitting diodes with different color temperatures and flux bins are produced. However, it is desired to use more than just one dedicated combination of bins to realize a certain product. In such a situation, the different sensitivity levels of the different bins with respect to the operation conditions (e.g. temperature, operation hours) of the light emitting diode unit will have an influence on the light quality like color temperature or intensity of the emitted light. By applying the emulation circuitry consisting again of an inductance 206, a capacitance 204 and a variable resistor 202, information on the operating condition or even on the actual color temperature of the emitted light can be used to set the value of the resistor 202. The resonant frequency of the circuit 200 can be selected to be in a certain frequency range in order to indicate the sensing properties of the light emitting diode unit.

Further, by using for example temperature dependent resistors as resistor 202 or by a suitable selection of temperature sensitive components for the capacitors or the inductor, information on the temperature of the light emitting diode lamp can be dynamically communicated to the driver 100 during operation of the light emitting device system.

For most systems, the temperatures of the driver and the light emitting diode lamp will be quite comparable in the off state. Hence, the driver can store the initial, sensed impedance information, compensated for its own initial temperature, as information on the desired ratio in the cold state. Then, during operation, the light emitting diode lamp will become hot and hence the impedance will change. This change may be detected by the driver during operation. Based on this information and the stored initial ratio, the driver can then adjust the current ratio to compensate for temperature induced light output variations.

In a first embodiment, depending on the selected frequency range for supplying power to the light emitting diodes and a selected range for emulating and sensing the impedance, it is possible to omit the voltage source for sensing: in the circuit shown in FIG. 3, the polarity of the drive current is reversed in a certain sequence, usually at a high rate to avoid flickering of the light emitting diodes. These drive current pulses can be designed to incorporate a dedicated frequency spectrum which can be used to replace the voltage source 208.

In a second embodiment, it is possible to use the voltage source 208 for modulating the output current of the power source 102. The power source 102 can be controlled by means of the controller 104. This was already discussed with respect to FIG. 2. The only difference is that in the embodiment of FIG. 3 the controller 104 can control both the power source 102 and the voltage source 208.

It has to be noted that the light emitting device system 112 may comprise more than only one sensor. These sensors can be used to detect sequentially different operating conditions of the light emitting device system 112. In a further embodiment of the invention, the emulation circuits influenced by the sensed operating conditions may be tuned to provide the sensed information to the driver at different detection conditions, e.g. at different frequencies or different polarities.

According to the previous embodiments, the sensor signal has a detectable impact when measuring the loading between the power terminals of the load. In case of a light emitting diode unit with two power supply terminals, this detectable impact is effective for the current passing through both power supply terminals at the same time, but with opposite polarity, and can be referred to as a differential mode effect.

However, it is also possible for the driver to make use of common mode effects to detect sensed information. In such an embodiment, the parasitic capacity of the light emitting diode unit with respect to the earth potential is utilized. Such an embodiment could comprise a light emitting diode unit with two power supply terminals and a metal housing for cooling. The sensor in the light emitting diode unit is adapted to influence the coupling between the power supply terminals and the metal housing.

In the simplest case, this could be a temperature sensitive switch, like a bi-metal switch, which either connects the housing to or disconnects it from one of the power supply terminals. To detect information which is sensed in the light emitting diode unit, the driver will superimpose a certain signal on the power supply terminal, preferably a high frequency alternating voltage. In case the sensor has connected one of the power supply terminals to the metal housing, the coupling capacity from the power supply terminal to earth will be higher than in the case that the sensor has disconnected the housing. By measuring the amount of high frequency current flowing through all power supply terminals, the driver can detect if there is a better or worse coupling from the light emitting diode unit to the earth potential.

This measurement allows detecting whether the switch is opened or closed and hence provides information about the sensed operation condition and the light emitting diode unit.

In a more elaborated embodiment, not only digital on/off switching but even a gradual increase of the coupling between the power supply terminal and the metal housing can be realized in the light emitting device system 112.

Further options are to either couple the power supply terminal to the metal housing or to use other metal parts rather than the metal housing, e.g. an internal metal heat sink inside a light emitting device system which is encased in a plastic housing, or to use other electrically conductive parts like for example a conductive screening of the inner side of a plastic housing or an extended copper area on a printed circuit board.

The power characteristics like voltage, frequency, polarity, waveform, at which a detection of the sensed information is possible can be designed to very specific requirements of the product. Different operation conditions can be sensed at the same time or sequentially and can be presented to the driver for detection. However, it is also possible that additionally or alternatively the sensed operation condition can also be comprised in a modulation, preferably a digital modulation of the coupling properties.

In a variant of FIGS. 2 and 3, the impedance emulating circuitry may be realized differently, e.g. such as to consist of a capacitor and a resistor, connected across a portion of the light emitting diode string, being connected in series with the light emitting diodes and consisting of a simple inductor in case of DC driving of the light emitting diodes or a parallel connection of an inductor and/or a resistor and/or a capacitor. In all cases the frequency ranges preferably should be selected appropriately to decouple the 'information portion' from the 'power supply portion' of the loading caused by the light emitting diode unit. In view of the current stress on the components determining the volume, costs and losses, parallel structures as in FIGS. 2 and 3 are preferred.

Figure 4:
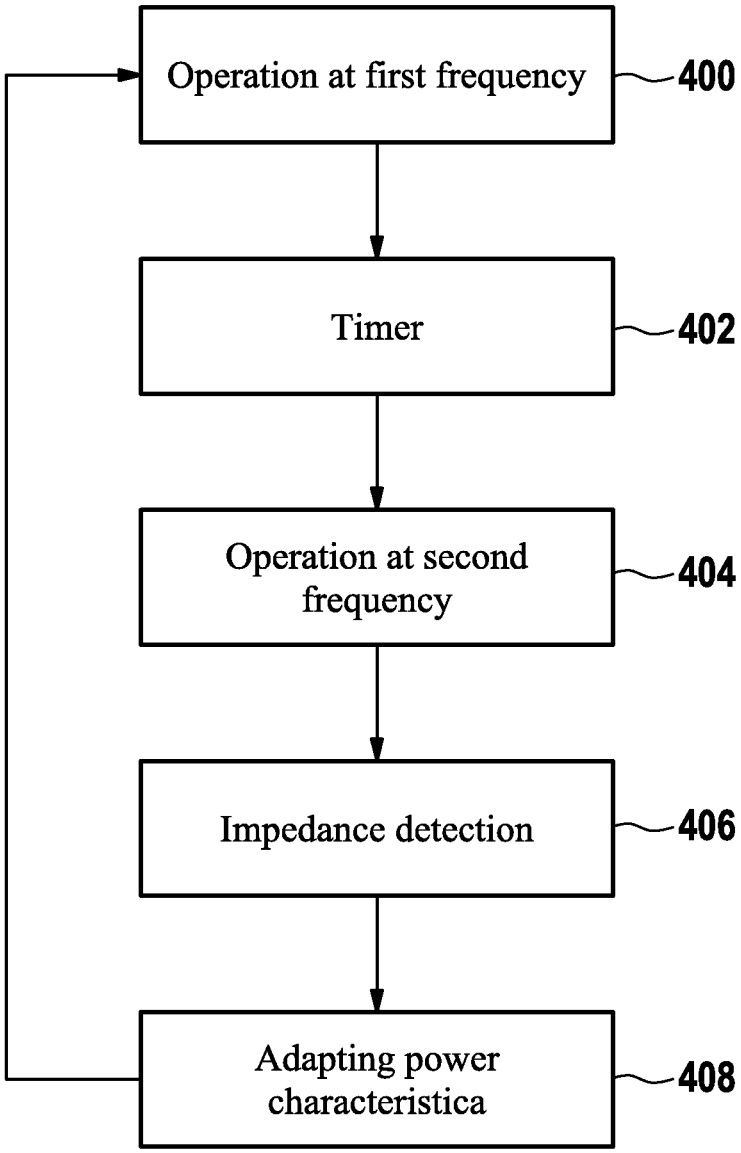
FIG. 4 is a flowchart illustrating a method of operating a light emitting device system and a driver.

FIG. 4 is a flowchart illustrating a method of operating a light emitting diode arrangement consisting of a light emitting device system and a driver. The method starts at step 400 at which the light emitting device system is operated at a first frequency. In other words, the driver provides electrical power to the light emitting device system by means of an alternating current of a first frequency. After a certain time has elapsed in step 402, the driver switches for operation at a second frequency which is different from the first frequency. The light emitting device system comprises an electric circuit which acts as an electrical loading means only when the light emitting device system operates at the second frequency in step 404. However, this circuit may comprise a switch which can be turned on and off, depending on certain operation conditions of the light emitting device system.

In step 406, the driver senses the electrical loading of the light emitting device system by detecting the impedance of the light emitting device system. Depending on the electrical loading of the light emitting device system, in step 408 the driver adapts the power characteristics of the electrical power supplied to the light emitting device system. The method continues with step 400 by switching to the operation mode in which the first frequency is used.

REFERENCE NUMERALS

100 driver
102 power supply
104 controller
106 detector
108 terminals
110 cable or rail
112 light emitting device system
114 terminals

116 light emitting diode
118 sensor
120 emulation module
122 controller
124 circuit
126 network
128 PC
200 circuit
202 resistance
204 capacitance
206 inductance
208 voltage source
210 light emitting diode string
212 sensing unit
300 light emitting diode string
302 light emitting diode string

The invention claimed is:

1. A driver for a light emitting device system comprising power supply terminals and a detector circuit, the power supply terminals being adapted for supplying electrical power from the driver to the light emitting device system and the detector circuit being adapted for capturing sensed information of the light emitting device system via the supply terminals by sensing an electrical loading of the terminals caused by the light emitting device system, and for determining an operating condition of the light emitting device system, using the sensed information, wherein the driver is further adapted to control the supplied power, depending on the determined operating condition, wherein the electrical power is supplied sequentially to the light emitting device system with a first and a second power signal characteristic, wherein the detector circuit is adapted for capturing the sensed information of the light emitting device system only during the provision of the electrical power with the second power signal characteristic, the first power signal characteristic being different from the second power signal characteristic, wherein the driver is adapted for setting an emulation circuit of the light emitting device system into resonance, thereby activating the emulation circuit, wherein the emulation circuit can be passively turned on and off by the driver, and wherein the emulation circuit influences the power flow when being activated, thereby emulating the electrical loading.

2. The driver of claim 1, wherein the sensed information is included in an impedance emulated by the light emitting device system and captured by the detector circuit by the sensing of the electrical loading of the terminals caused by the light emitting device system.

3. The driver of claim 2, wherein the sensed information is included in a sequence of impedances emulated by the light emitting device system and captured by the detector circuit by the sensing of the electrical loading of the terminals caused by the light emitting device system.

4. The driver of claim 2, wherein the sensed information is represented digitally in the sequence of impedances emulated by the light emitting device system.

5. The driver of claim 1, wherein the driver is adapted for switching between a first and a second operation mode, wherein in the first operation mode the driver is adapted to supply the power to the light emitting device system with the first power signal characteristic and the detector circuit is disabled, and wherein in the second operation mode the driver is adapted to supply the power to the light emitting device system with the second power signal characteristic and the detector circuit is enabled for capturing the sensed information of the light emitting device system.

6. The driver of claim 1, wherein the detector circuit is adapted for capturing the sensed information of the light emitting device system by demodulating the impedance emulated by the light emitting device system.

7. The driver of claim 1, wherein the driver is further adapted to provide the sensed information to an external control system and to receive a control command from the external control system in response to the provision of the sensed information, wherein the driver is adapted to control the supplied power, depending on the control command.

8. The driver of claim 1, wherein the electrical loading of the light emitting device system is further sensed with respect to earth potential.

9. The light emitting device system of claim 8, wherein the sensor is selected from the group consisting of a temperature sensor, a light sensor, a humidity sensor, a dust sensor, a fog sensor and a proximity sensor.

10. A light emitting device system comprising power supply terminals, a sensor and an emulation circuit, the power supply terminals being adapted for receiving electrical power from a driver, the sensor being adapted for sensing an operating condition of the light emitting device system, wherein the light emitting device system is further adapted for providing the sensed operating condition as sensed information via the power supply terminals to the driver by emulating an electrical loading, depending on the detected operating condition, wherein the emulation circuit of the light emitting device system is adapted for being set into resonance, thereby being activated, the emulation circuit being passively turned on and off by the driver, wherein the emulation circuit is adapted for influencing the power flow when being activated, thereby emulating the electrical loading, wherein the sensed operating condition is encoded as information in a certain impedance which is emulated by the light emitting device system and processed to the driver and wherein the sensed operating condition has a detectable impact when measuring the electrical loading between power terminals of the driver.

11. The light emitting device system of claim 10, wherein the light emitting system is operable for light emission by sequentially receiving electrical power with a first or a second power signal characteristic, wherein the light emitting device system further comprises an emulation circuit adapted for emulating the electrical loading, wherein the emulation circuit is adapted to emulate the electrical loading with a higher effectiveness when receiving the electrical power with the second power signal characteristic than when receiving the electrical power with the first power signal characteristic.

12. The light emitting device system of claim 10, wherein the electrical loading of the light emitting device system is further emulated with respect to earth potential.

13. The light emitting device system of claim 10, wherein the operating condition comprises an actual light emission characteristic of the light emitting device system and/or a temperature of the light emitting device system and/or an environmental condition of the environment in which the light emitting device system is being operated and/or a time of operation of the light emitting device system.

* * * * *